US006810610B2

(12) United States Patent
Hardman et al.

(10) Patent No.: US 6,810,610 B2
(45) Date of Patent: Nov. 2, 2004

(54) EDGE ATTACHMENT FOR THE BUCKET OF EARTH MOVING EQUIPMENT

(75) Inventors: Jason W. Hardman, West Jordan, UT (US); Craig R. Scharp, Salt Lake City, UT (US)

(73) Assignee: Dura-Tuff Wear Products, L.L.C., Salt Lake City, UT (US)

( * ) Notice: Subject to any disclaimer, the term of this patent is extended or adjusted under 35 U.S.C. 154(b) by 0 days.

(21) Appl. No.: 10/350,394

(22) Filed: Jan. 23, 2003

(65) Prior Publication Data

US 2003/0204974 A1 Nov. 6, 2003

(Under 37 CFR 1.47)

Related U.S. Application Data

(60) Provisional application No. 60/380,087, filed on May 6, 2002.

(51) Int. Cl.[7] ..... E02F 3/76

(52) U.S. Cl. ..... 37/407; 37/404; 37/450; 37/454; 172/719

(58) Field of Search ..... 37/403, 450, 454, 37/449, 405, 407, 446, 404, 266; 172/249, 701, 701.1, 719, 701.3

(56) References Cited

U.S. PATENT DOCUMENTS

| | | | | | |
|---|---|---|---|---|---|
| 3,469,330 | A | * | 9/1969 | Hood et al. | 37/404 |
| 3,523,380 | A | * | 8/1970 | Griffin et al. | 37/403 |
| 3,765,109 | A | | 10/1973 | Daviduke | |
| 3,942,271 | A | * | 3/1976 | George | 37/404 |
| 3,984,929 | A | * | 10/1976 | Meyer et al. | 37/449 |
| 4,009,529 | A | * | 3/1977 | Johnson | 37/404 |
| 4,043,060 | A | * | 8/1977 | Stepe | 37/446 |
| 4,208,815 | A | | 6/1980 | Yunker et al. | |
| 4,411,585 | A | * | 10/1983 | Quinn | 414/724 |
| 5,212,897 | A | * | 5/1993 | Jefferson | 37/403 |
| 5,253,449 | A | * | 10/1993 | Webb et al. | 37/446 |
| 5,596,825 | A | | 1/1997 | Von Schalscha | |
| 5,794,370 | A | * | 8/1998 | Haagenstad et al. | 37/404 |
| 5,918,389 | A | * | 7/1999 | Hall | 37/407 |
| 6,070,345 | A | * | 6/2000 | Akaki et al. | 37/407 |

FOREIGN PATENT DOCUMENTS

| | | |
|---|---|---|
| EP | 0 866 178 A2 | 9/1998 |
| EP | 0 866 178 A3 | 3/1999 |
| JP | 09 078637 | 7/1997 |
| JP | 09 137477 | 9/1997 |

* cited by examiner

*Primary Examiner*—Heather Shackelford
*Assistant Examiner*—Thomas A Beach
(74) *Attorney, Agent, or Firm*—Snell & Wilmer LLC

(57) ABSTRACT

The present invention provides an edging device for an earth moving machine having a bucket including at least one receiver detachably attachable to the bucket of earth moving machine. The receiver has a plate and an attachment member for engaging the bucket. The receiver can be sized to extend substantially the width of a bucket and the edge member can be substantially co-extensive in length with the receiver. The edge member is configured to be detachably attached to the receiver, where the edge member has a leading edge for contacting the earth.

7 Claims, 5 Drawing Sheets

EDGE ATTACHMENT FOR THE BUCKET OF EARTH MOVING EQUIPMENT

RELATED APPLICATIONS

This patent application claims priority to, and the benefit of, the U.S. provisional patent application entitled "EDGE ATTACHMENT FOR THE BUCKET OF EARTH MOVING EQUIPMENT" filed on May 6, 2002 as U.S. Ser. No. 60/380,087, which is hereby incorporated by reference.

FIELD OF INVENTION

This invention relates to earth moving equipment, such as backhoes, excavators, front loaders and skid steers, and specifically relates to means for modifying the bucket associated with such earth moving equipment to provide a removable edging device.

BACKGROUND OF THE INVENTION

The conventional bucket of a backhoe, and other earth moving equipment, has teeth along the front edge of the bucket that makes the bucket digging aggressive, but often leaves behind a rough floor that needs additional cleaning or compaction before completion. It is the typical practice in the industry to weld a flat plate to the edge of the bucket to achieve a cleaner working area. The edge picks up the loose dirt and rocks that the bucket teeth leave behind. With an edge on the bucket, the operator can easily dig to the desired depth without disturbing the ground below grade. This results in less back fill and compaction.

Welding an edge to the bucket teeth requires access to a welder and someone with the technical expertise to perform the welding job. Once the edge is welded on to the bucket, it is very difficult to change back to teeth. Most often the teeth are not reused because of the time required in cutting out the welds. Therefore, the whole system is thrown away when the edge is worn, and the bucket is difficult to reuse.

It would be advantageous, therefore, to provide a means for providing the bucket of earth moving equipment with a removable edge member that can be easily and quickly bolted to the bucket for use in smoothing the ground surface, but which can later be removed without damaging a bucket, thereby also allowing the edge member to be reused at a later time.

SUMMARY OF THE INVENTION

The present invention includes an edging device for an earth moving machine having a bucket including at least one receiver detachably attachable to the bucket of earth moving machine. The receiver has a plate and an attachment member for engaging the bucket. The edge member is configured to be detachably attached to the receiver, where the edge member has a leading edge for contacting the earth.

BRIEF DESCRIPTION OF EXEMPLARY DRAWINGS

The subject invention will hereinafter be described in the context of the appended drawing figures, wherein like numerals denote like elements, and:

DETAILED DESCRIPTION OF EXEMPLARY EMBODIMENTS

Figure 1:
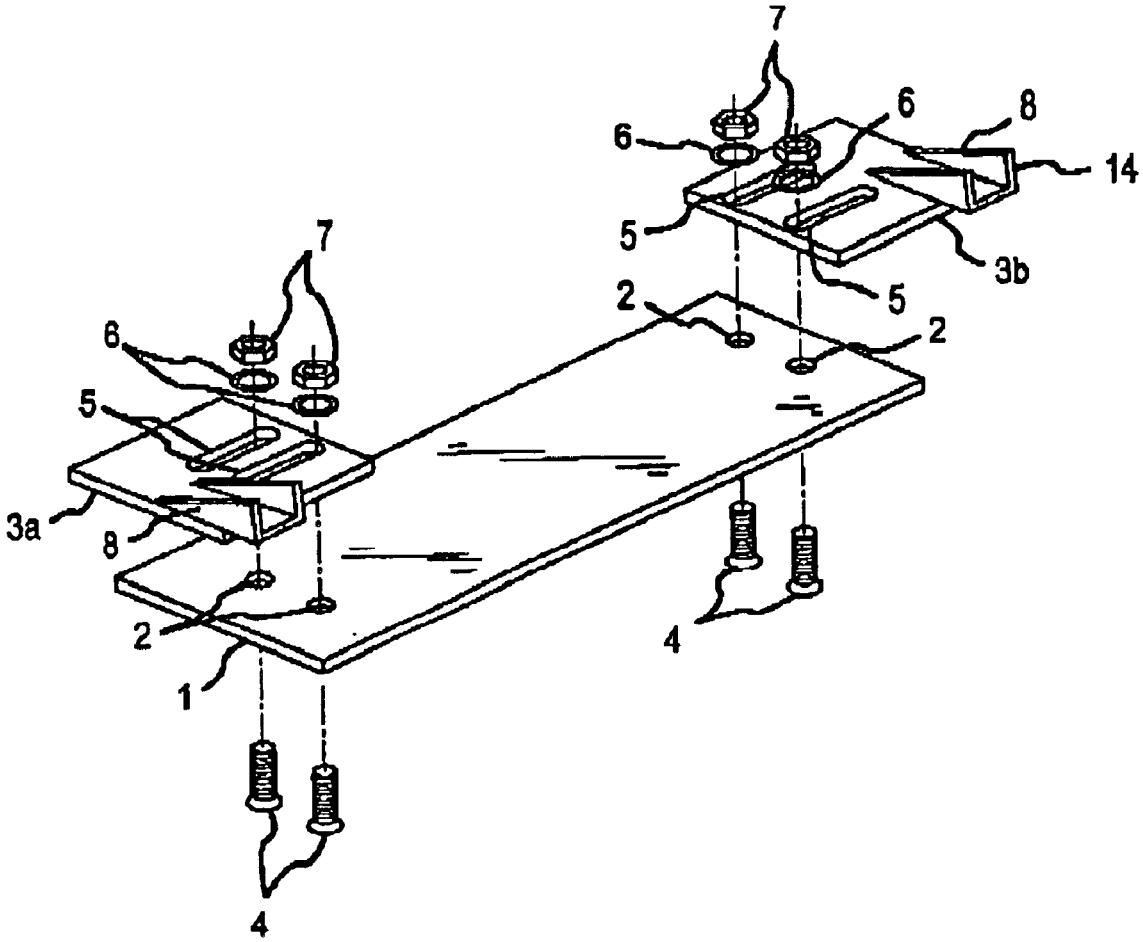
FIG. 1 illustrates earth moving equipment in accordance with an exemplary embodiment of the present invention.

The present invention, referred to herein as a "Bolt-on Edge System," overcomes the problems presently encountered in the industry, as described above. The Bolt-on Edge System is a ground engaging tool that replaces the accepted practice of welding an edge to the bucket teeth on earth moving equipment such as backhoes, loaders and excavators.

The Bolt-on Edge System consist of two major components: an edge member or plate and means for attaching the edge member to the bucket of an earth moving machine. The edge member is the width on the bucket and may be about eight to ten inches in length. The edge member is structured with a surface to which may be attached a receiver to secure the edge member to a bucket. The means for attaching the edge member to the bucket may include receivers that are secured to the edge member, such as by welding. The receivers are structured to fit over at least two of the bucket tooth adaptors to provide a mounting surface of the edge member. This makes a very flexible system compared to having the edge permanently welded to the bucket. Alternatively, the edge member may be configured with structures to which the teeth, which are already attached to the bucket, may be detachably secured for attachment of the edge member to the bucket.

The Bolt-on Edge System attaches with nuts and bolts, so the installation can be preformed anywhere, by anyone. The Bolt-on System is as easy to install as changing bucket teeth. Changing from an edge to teeth is now a quick task that assures the operator of having the right cutting tool for the right job.

The receivers are designed to outlast the edge. The worn edge member can be quickly replaced by removing the hardware and reinstalling the edge member with the new wear side down, on the original receivers. When the edge member is completely worn on both wear surfaces, the worn edge member can be replaced with a new edge member on the original receivers. This time saving procedure results in a major reduction in cost.

The invention is more fully described by reference to the following descriptions of the drawing figures made a part of this application.

FIG. 1 illustrates the basic elements of the invention, including the edge member 1, which has a flat cutting edge with four plow bolts holes 2. Two receivers are shown, including left receiver 3*a* and right receiver 3*b*. Each receiver is attachable to the edge member 1 by two plow bolts 4. The plow bolts 4 extend through the edge member 1, through the slotted holes 5 of the respective receivers 3*a* and 3*b*, through the flat washers 6, then through the threaded hex nuts 7. The slotted holes 5 of the receivers allow some lateral adjustability when attaching the edge member 1 to different sizes of buckets.

Figure 2:
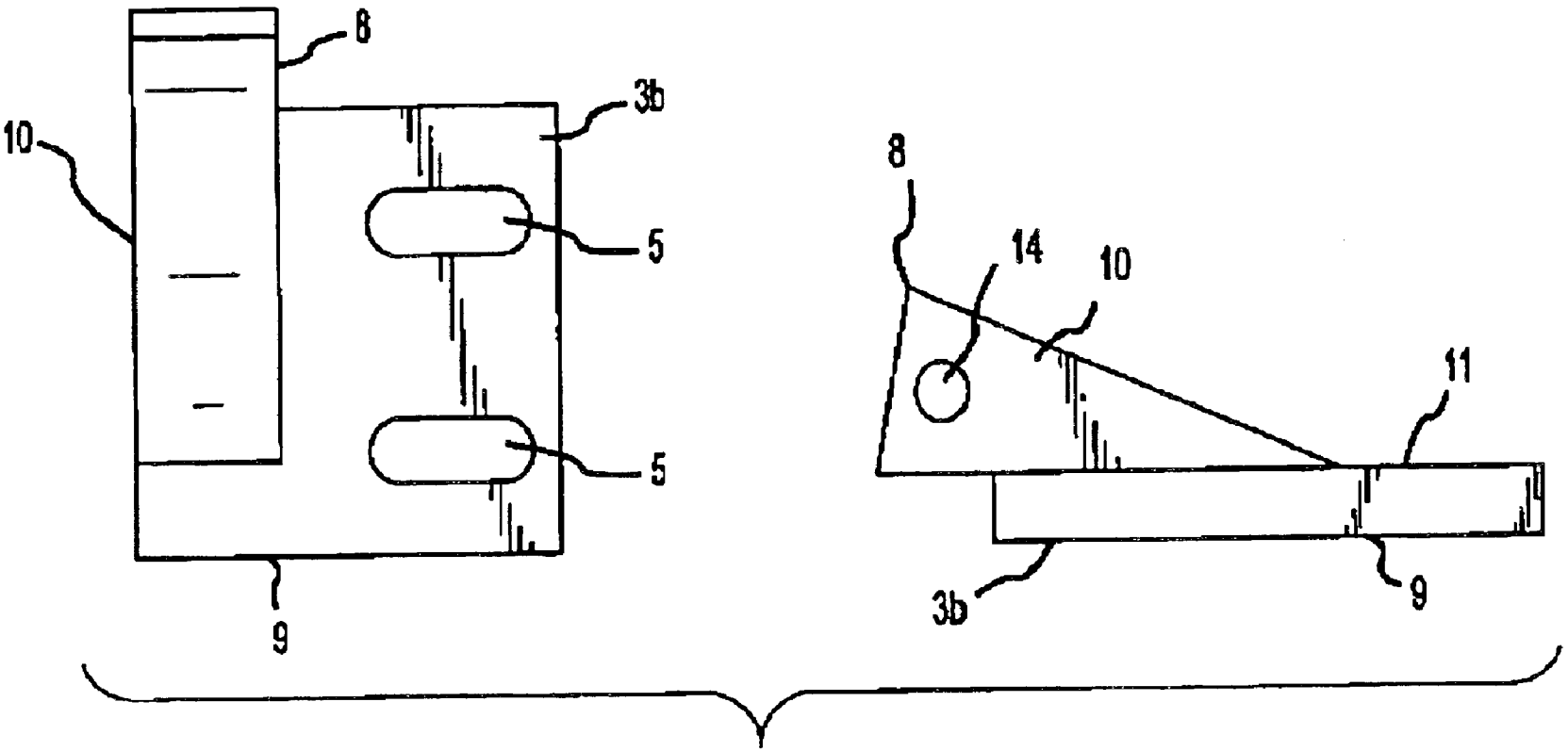
FIG. 2 illustrates receivers in accordance with an exemplary embodiment of the present invention.

FIG. 2 illustrates more fully the configuration of the receivers, the right receiver 3*b* being shown in FIG. 2. Each receiver 3*a* and 3*b* may be configured with an attachment member 8 that is secured to the plate 9 of the receiver. The attachment member 8 may be, as shown in FIG. 2, a conventional tooth 10 of the type that is used on a backhoe bucket. The tooth 10 is permanently secured to the plate 9 by means such as welding. In an alternative embodiment of the invention, the receivers 3*a* and 3*b* may be configured with a surface 11 or structure which allows an attachment member 8, such as a conventional tooth, to be welded to the receiver, or to the edge member, on site.

Figure 3:
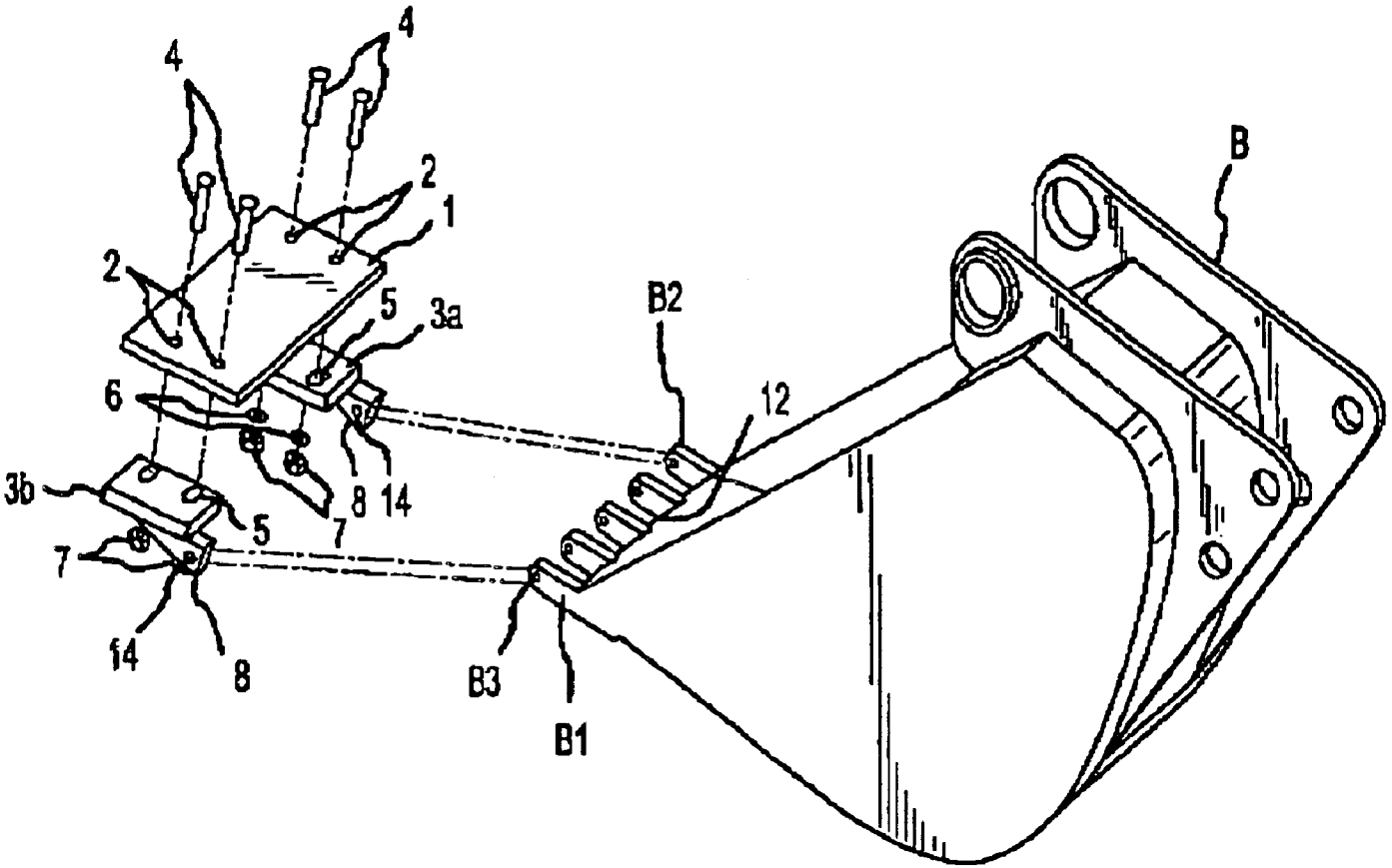
FIG. 3 illustrates the bucket of a backhoe in accordance with an exemplary embodiment of the present invention.

FIG. 3 illustrates further how the invention is structured and how it attached to the bucket B of a backhoe. The bucket B is formed with a plurality of teeth adapters B1 which are positioned along the leading edge 12 of the bucket B. Conventionally, teeth are attached to the teeth adapter B1 by positioning a pin through pin holes B3 formed in each teeth adapter B1. In the present invention, the attachment members. 8 of the receivers 3*a* and 3*b* are positioned on the outermost, left and right, teeth adapters B1 and B2, but the receivers may be positioned to attach any of the teeth adaptors along the front edge of the bucket. A conventional pin is positioned through the hole 14 of the attachment member 8 and the hole B3 of the teeth adapter B1 to secure the receiver 3*b* to the bucket B.

Figure 4:
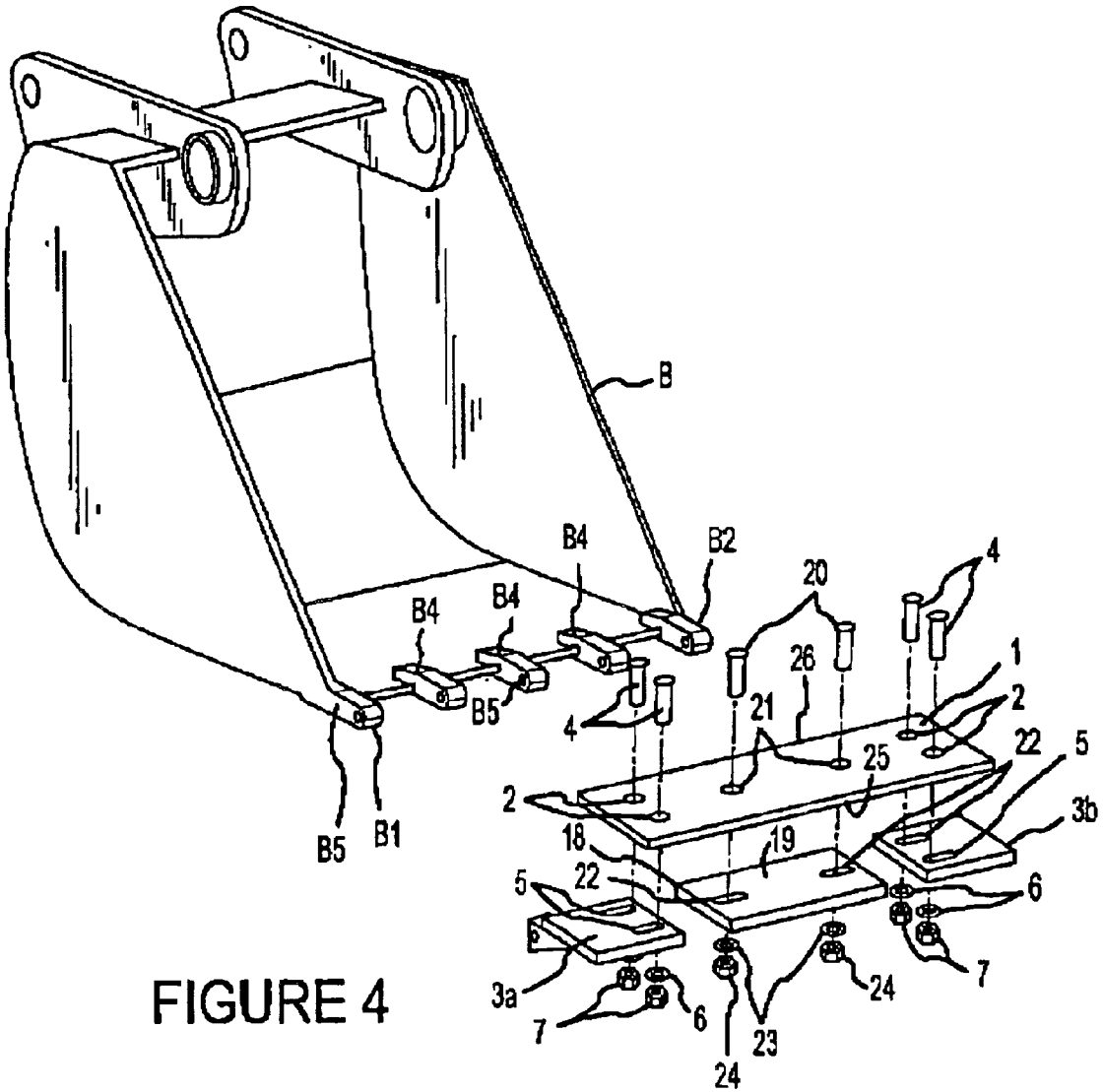
FIG. 4 illustrates a center receiver in accordance with an exemplary embodiment of the present invention.

FIG. 4 illustrates an alternative embodiment of the present invention further comprising a center receiver 18 in addition to the previously described left receiver 3*a* and right receiver 3*b*. The center receiver 18 comprises a plate 19 to which may be attached one or more attachment members (not seen in the view of FIG. 4) in the same manner as previously described for the left receiver 3*a* and right receiver 3*b*. The center receiver 18 attaches to one or more of the bucket adapters B4 by insertion of pins through holes formed in the attachment members and the holes B5 in the bucket adapters B4, as previously described. The edge member 1 is attached to the left receiver 3*a* and right receiver 3*b* in the manner previously described in FIGS. 1–3. The edge member 1 is also attached to the center receiver 18 by positioning the plow bolts 20 through holes 21 formed through the edge member 1, through slots 22 formed in the center receiver 18, through flat washers 23 and then through threaded nuts 24.

It should be noted that when the leading edge 25 of the edge member 1 becomes worn after use, the edge member 1 may be detached from the receivers 3*a*, 3*b* and 18 and reattached to the receivers 3, 3*b* and 18 with the opposing edge 26 extending outwardly to thereby provide a new flat edge. The same extended wear of the edge member 1 is achievable in the embodiment shown in FIGS. 1–3.

Figure 5:
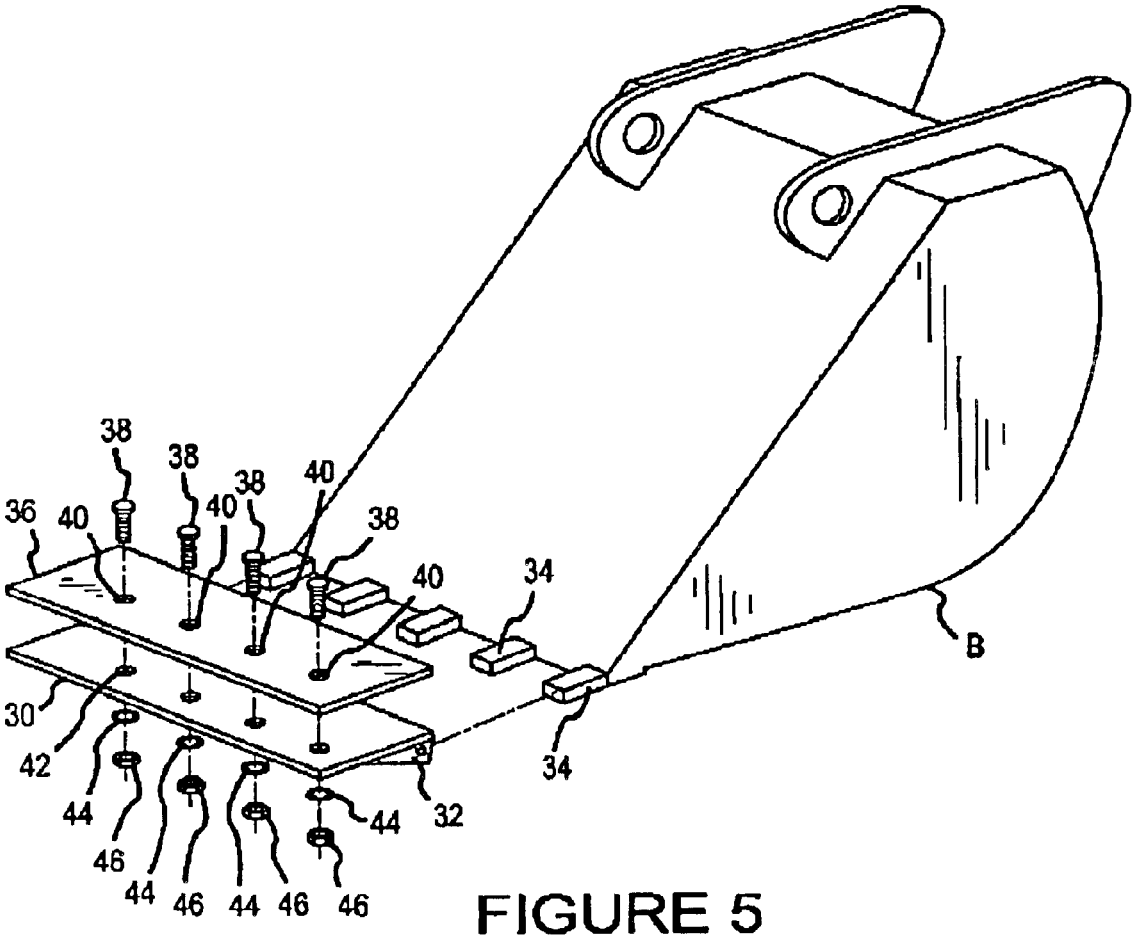
FIG. 5 illustrates earth moving equipment for more aggressive digging conditions in accordance with an exemplary embodiment of the present invention.

FIG. 5 illustrates yet another alternative embodiment of the present invention which may be used in applications presenting tougher and more aggressive digging conditions. In this embodiment, the invention is comprised of a base receiver plate 30 which extends essentially the width of the bucket B. The base receiver plate 30 may be welded directly to the bucket teeth 32, which are already attached by pin means to the bucket adapters 34. It should be noted that in FIG. 5, tooth 32 is shown already welded to base receiver plate 30 and appears to be detached from the bucket adapter 34; however, the teeth 32 are attached to the bucket B. The embodiment of FIG. 5 further comprises an edge member 36 which is detachably attached to the base receiver plate 30 by insertion of a plurality of plow bolts 38 through respective holes 40 formed in the edge member 36, then through holes 42 formed in the base receiver plate 30. The plow bolts 38 are secured in place by respective engagement with washers 44 and threaded nuts 46. As previously described, the edge member 36, when worn, can easily be detached and turned or replaced with a new edge member 36.

Figure 6:
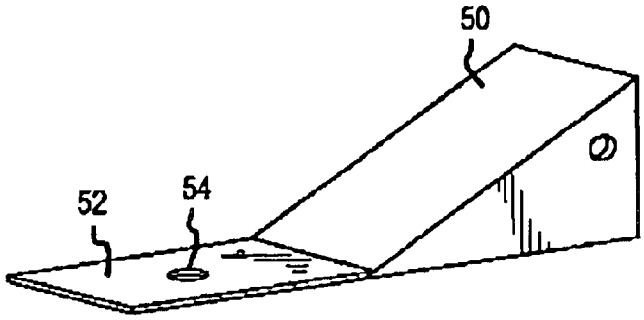
FIG. 6 illustrates a tooth in accordance with an exemplary embodiment of the present invention.

FIG. 6 illustrates an exemplar modified tooth 50 that may be used to connect the edge member 1 of the invention to the bucket of earth moving equipment. The tooth 50 is formed with a flange 52 extending outwardly from the tooth 50 and a hole 54 is formed through the flange 52. The hole 54 is sized to receive a bolt therethrough for attaching a receiver 3*a*, 3*b*, 18 or 30 to the modified tooth 50. Thus, in operation, the conventional teeth attached to a bucket can be removed and replaced with the modified teeth 50 shown in FIG. 6, and the receivers can be secured to the modified teeth 50 by bolts or other means. Alternatively, the edge member may be secured directly to the modified teeth 50.

The Bolt-on Edge System is like no other attachment offered today. Most attachments are limited to light applications. The Bolt-on Edge System can clean up the job, and do a variety of jobs, such as sod striping and other light duties. However, it was designed to replace an edge that is welded to the teeth and intended to provide hours of carefree digging in moderate to tough digging conditions.

In the foregoing specification, the invention has been described with reference to specific embodiments. However, it will be appreciated that various modifications and changes can be made without departing from the scope of the present invention as set forth in the claims below. The specification and figures are to be regarded in an illustrative manner, rather than a restrictive one, and all such modifications are intended to be included within the scope of present invention. Accordingly, the scope of the invention should be determined by the appended claims and their legal equivalents, rather than by the examples given above. For example, the steps recited in any of the method or process claims may be executed in any order and are not limited to the order presented in the claims.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as critical, required, or essential features or elements of any or all the claims. As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus. Further, no element described herein is required for the practice of the invention unless expressly described as "essential" or "critical".

What is claimed is:

1. An edging device for an earth moving machine having a bucket, comprising:

at least one left receiver and at least one right receiver, each receiver detachably attachable to a tooth adapter at an end of the bucket of an earth moving machine, each of the left and right receivers each having a plate and an attachment member for engaging the tooth adapter of the bucket; and an edge member detachably attached to each of the left and right receivers, each of the plates providing lateral adjustability of the edge member relative to the bucket, the edge member having a leading edge for contacting earth.

2. The edging device of claim 1 wherein the edge member has reversible wear surfaces.

3. The edging device of claim 1 further comprising a center receiver.

4. The edging device of claim 3 wherein the left, right, and center receivers are sized to extend substantially the width of the bucket and the edge member is substantially co-extensive in length with the left, right, and center receivers.

5. The edging device of claim 3 wherein the center receiver is detachably attachable to the bucket.

6. An edging means for an for an earth moving machine having a bucket, comprising:

at least one left receiver means and at least one right receiver means, each receiver means detachably attachable to a tooth adapter at an end of the bucket of an earth moving machine, each of the left and right receiver means each having a plate and an attachment means for engaging the tooth adapter of the bucket; and an edge member detachably attached to each of the left and right receiver means, each of the plates providing lateral adjustability of the edge member relative to the bucket, the edge member having a leading edge for contacting earth.

7. The edging means of claim 6 further comprising a center receiver means.

* * * * *